US006023801A

United States Patent [19]

Lamm

[11] Patent Number: 6,023,801

[45] Date of Patent: Feb. 15, 2000

[54] THERAPEUTIC HEADREST

[76] Inventor: Kenneth Lamm, 643 E. Wine Plum Dr., Tucson, Ariz. 85704

[21] Appl. No.: 09/031,384

[22] Filed: Feb. 26, 1998

[51] Int. Cl.[7] ..... A47G 9/02

[52] U.S. Cl. ..... 5/636; 5/638; 5/640

[58] Field of Search ..... 5/636, 638, 640, 5/725, 622, 639, 642, 643, 637

[56] References Cited

U.S. PATENT DOCUMENTS

| | | | |
|---|---|---|---|
| D. 229,266 | 11/1973 | Zacharias | 5/636 |
| 2,169,117 | 8/1939 | Utermohlen | 5/636 |
| 2,239,003 | 4/1941 | Jones | 5/638 |
| 3,981,032 | 9/1976 | Brooks | 5/636 |
| 4,006,604 | 2/1977 | Seff | 5/640 |
| 5,313,678 | 5/1994 | Redewill | 5/636 |
| 5,343,582 | 9/1994 | Baylor | 5/636 |
| 5,546,619 | 8/1996 | Braun | 5/640 |
| 5,642,543 | 7/1997 | Huntley | 5/640 |

*Primary Examiner*—Michael F. Trettel
*Assistant Examiner*—Fredrick Conley
*Attorney, Agent, or Firm*—Mark E. Ogram P.C.

[57] ABSTRACT

An improved headrest adapted for cradling a patient's face while medical treatment is being performed on the patient's posterior (i.e. back, shoulders, and rear of head). The U-shaped face rest/cradle is supported by four legs which are selectively lengthened to meet the situation required to provide full support to the face during the treatment. Extension legs are also provided which raise the U-shaped face rest so that the patient is able to be in a sitting position. In one embodiment of the invention a fan directs air across the patient's face to keep the patient more comfortable. Music is also communicated to the patient in some embodiments through either speakers or a vibration in the face-rest which conducts the musical sounds through the facial bones of the patient.

19 Claims, 6 Drawing Sheets

THERAPEUTIC HEADREST

BACKGROUND

This invention relates generally to therapeutic apparatus and more particularly to an apparatus used to hold a patient's head during medical and physical therapy treatment.

In a great many instances, it is important for a human to lie comfortably while in a face-down or prone position. Instances of such a position are found often in chiropractic care, medical examinations, and sun-bathing.

To assist in this procedure, the current technique is to roll towels which are then positioned around the face to provide some level of support for the individual's head. This approach though is typically uncomfortable for the patient, the towels must be adjusted constantly, and the towels tend to restrict airflow to the user which creates a "claustrophobic feeling". None of these results assist in the treatment of the patient.

Another problem with the current technique is that an excessive number of towels must be used to maintain a clean or sterile environment.

This technique of using rolled towels is also totally incapable of addressing the situation where the patient is to be seated and only slightly bent forward.

It is clear that there is a need for an improved apparatus which will properly support a patient's face during a medical procedure.

SUMMARY OF INVENTION

The present invention produces an apparatus which provides a comfortable support for a patient's head while lying prone or sitting. In this manner, the invention is an improved headrest adapted to cradle a patient's face while medical treatment is being performed on the patient's posterior (i.e. back, shoulders, and rear of head).

A U-shaped member is created which is supported by legs to maintain it away from the base surface (i.e. an examination table, the floor, the beach, etc.). The U-shaped member cradles the patient's face by supporting along the patient's cheeks and forehead.

The U-shaped face-rest/cradle is supported by four legs. These legs are able to be selectively lengthened to meet the situation required to provide full support to the face during the treatment. Extension members are securable to the ends of the legs. These extension members come in a variety of lengths allowing the U-shaped face rest to be tilted forward to back, or side to side to provide optimal comfort for the user.

In some embodiments of the invention, the extensions are provided with expanded feet to keep the legs from settling into the base surface (i.e. the sand on a beach).

A number of embodiments of the leg extensions are contemplated by this invention. In some embodiments, the leg extensions are rubber cushioned to provide a "soft" support. In still other embodiments, the legs are spring loaded and a soothing vibration is forced into the face-rest to ease the patient's anxiety. In still other embodiments, the leg extensions are adapted to mate with each other to obtain an almost endless grouping of lengths.

Extension legs are also provided which raise the U-shaped face rest so that the patient is able to be in a sitting position. In this situation, the extension legs allow the apparatus to be placed on a desk or table top; the patient then sits in a chair and bends forward to allow the head-rest to cradle and support their face.

In some embodiments of the invention, the extension legs have sufficient length to permit the apparatus to be extended from the floor. In this embodiment, cross supports between the legs are also provided to keep the legs and apparatus from shaking or wobbling.

Cushioning of the patient's face is accomplished using foam pads which are secured around the U-shaped face-rest. These pads in some embodiments extend around each component section of the U-shape; in other embodiments, a single U-shaped pad is used.

In one embodiment, the entire face-support is periodically disassembled and placed within a washing machine to be properly cleaned and sterilized.

In one embodiment of the invention, a fan directs air across the patient's face to keep the patient more comfortable.

In some applications, a heater/cooler is also used to adjust the temperature of the air flowing from the fan. This allows the doctor or therapist to soothe an anxious patient by providing a cool air-flow to eliminate any "closed in" feeling.

To further calm the patient, in some embodiments of the invention, music is also communicated to the patient. This is accomplished in a variety of ways including auditory speakers and direct conduction of the sound via the face-rest and the facial bones of the patient.

In the preferred embodiment, the facial support has adjustments on the front and back for changing the angles of the neck for optimal comfort. Further, the support is preferably "U" shaped to support the head on the sides of the face and the forehead.

While the apparatus is made from a variety of materials, the preferred material of use is polyvinyl-chloride (PVC) plastic with foam padding as cushions. The preferred embodiment is made in this manner;

A. Three(3) pieces of 1" inside diameter thick wall PVC pipe (e.g. two(2) 6 inch side pieces and one(1) three inch forehead piece) are padded with a tubular foam pad approximately ⅜" to ½" thickness.

B. The two front corner pieces each have two(2) 90 degree angle fittings and a screw type adjustable footing. This is used as a front leg or support.

C. The back leg or support has a removable end piece attached to a 1⅛" length of 1" thick wall of PVC pipe.

D. Two Front end extensions are provided with a screw attachment. 5–6" long. ¾" tubular PVC with end cap.

Adjustment of the slope and height of the apparatus is accomplished through the removal of various legs or support pieces which allows the head to be supported in a neutral, flexion, or extension position.

In one embodiment, a disposable absorbent cover is used to provide a clean soft protection to prevent cross infection between users and to keep the foam pads from becoming damaged by sweat and oil. The disposable absorbent cover is "U" shaped. The absorbent cover is placed on during each use.

In one embodiment of the invention, a "skid resistant" member is included. This skid resistant member serves as an attaching interface for the head support so that the user is able to be positioned in a sitting position with the head still supported while maintaining the head support in place against the user's face.

In another embodiment of the invention, the user is able to use the head support on an uneven surface by placing the head support on the "skid resistant" material and then onto a rigid flat member that is optionally attached to a lounge chair for a prone sun bathing position.

In the preferred embodiment, the adjustable legs are adapted to mate with the extension at the bottom of the head rest. By selective attachment, the angle of the head rest is easily adjusted. Further by placing a longer screw type support for the front leg the head support is easily used while seated for massage or exercise.

The device is particularly adapted for use in surgery to support the head in a neutral position to facilitate the successful surgery of the posterior aspect of the neck or the back.

The invention, together with various embodiments thereof, will be more fully explained by the accompanying drawings and the following description.

DRAWINGS IN BRIEF

DRAWING IN DETAIL

Figure 1:
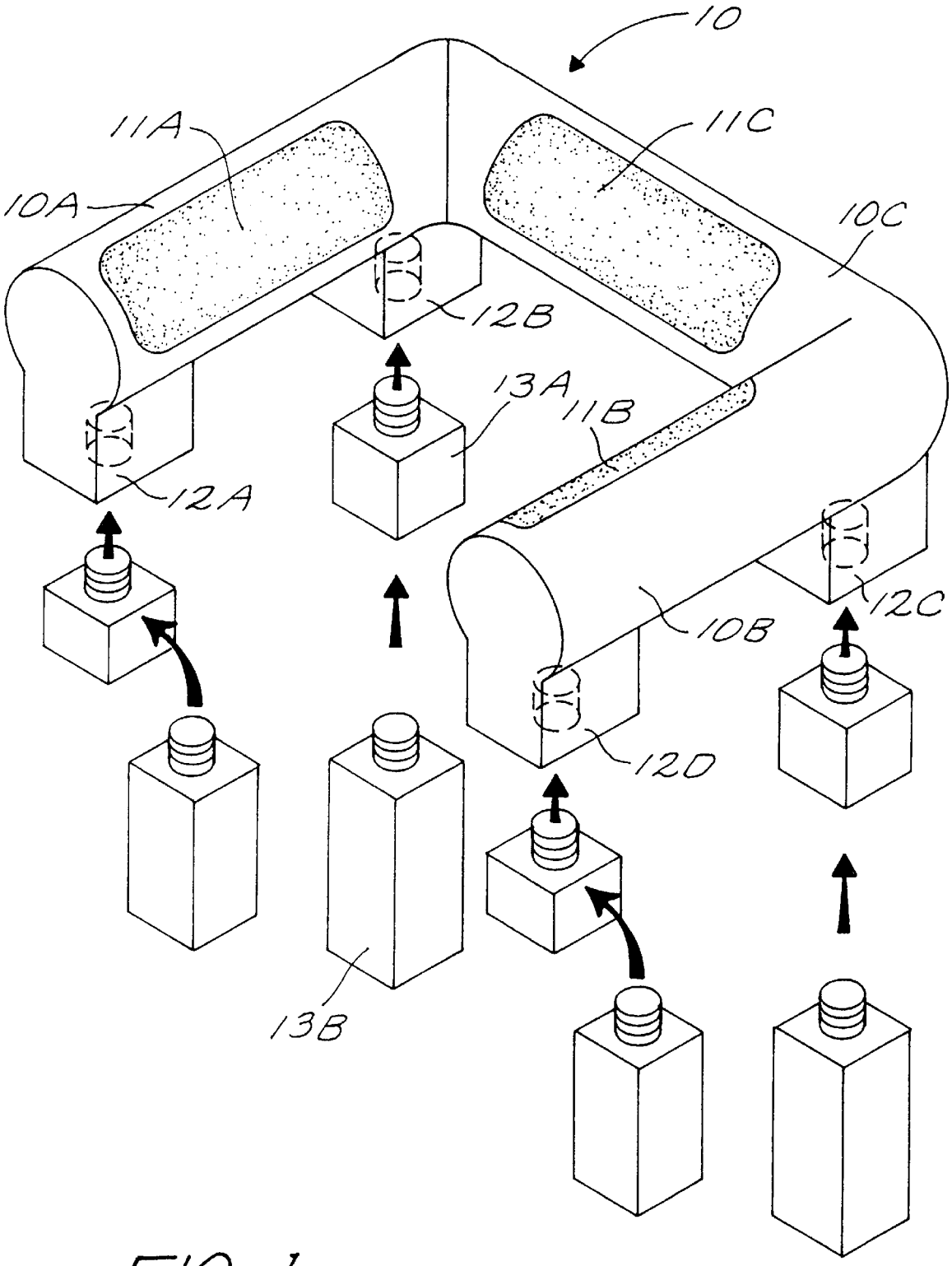
FIG. 1 is a perspective view of the preferred embodiment of the invention.

FIG. 1 is a perspective view of the preferred embodiment of the invention.

Head-rest 10 is generally U-shaped having base member 11C and two extension members 11A and 11B. Check rest 11A and 11B are formed to cushion the cheeks of the patient. Forehead rest 11C is provided to cushion the forehead of the patient when the patient's face is positioned against and supported by head-rest 10.

Head-rest 10 is supported by legs 12A, 12B, 12C, and 12D. The length of legs 12A, 12B, 12C, and 12D, in this embodiment, are selectively lengthened by adding extension members such as 13A and 13B which are secured into receptacles at the base of each leg. Further, extension members 13A and 13B are securable to each other to provide a combined lengthened extension member.

By selectively choosing the extension members, the angle or slope of head-rest 10 is controllable. This provides for greater comfort for the patient.

Figure 2:
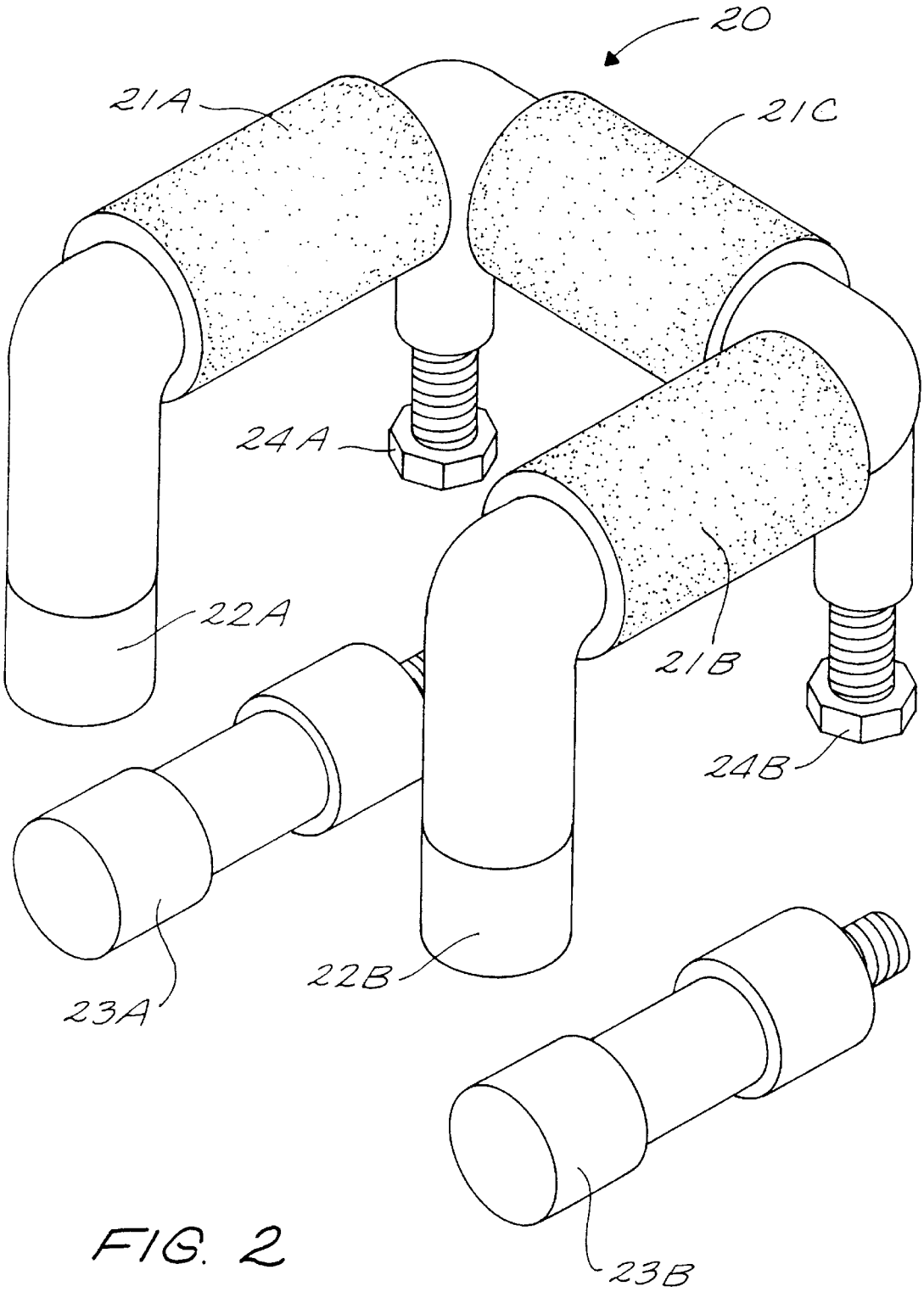
FIG. 2 is a perspective view of an alternative embodiment of the invention.

FIG. 2 is a perspective view of an alternative embodiment of the invention.

As before, head-rest 20 is generally U-shaped. Cheek rests 21A and 21B, in this embodiment totally encircle their respective portions of head-rest 20. Similarly, forehead rest 21C totally encircles its portion of head-rest 20.

In this embodiment, the length of the legs supporting the base portion of head-rest 20, are adjustable by screw mechanisms 24A and 24B. Either the patient or the care-giver is able to adjust the relative angle of head-rest 20 by a simple adjustment of the screw mechanisms 24A and 24B.

This embodiment is also equipped with removable back-leg supports 22A and 22B. The base of each back-leg support is coated with a skid resistant material to create a heightened bonding between head-rest 20 and whatever surface it is resting upon.

This embodiment allows the height of head-rest 20 (the distance from the base surface such as the top of an examination table) to be adjusted through the addition of leg supports 23A and 23B. While only two leg supports are shown, any number are contemplated.

Leg supports 23A and 23B are adapted to be secured into head-rest 20 once either the screw mechanisms (24A or 24B) and/or the back leg supports (22A or 22B) are removed. The removed portion is then secured to the leg extension (23A or 23B). In this manner, when the patient is to be in a sitting position, the "height" of head-rest 20 is adjustable to meet the particular patient's "sitting height".

Figure 3A:
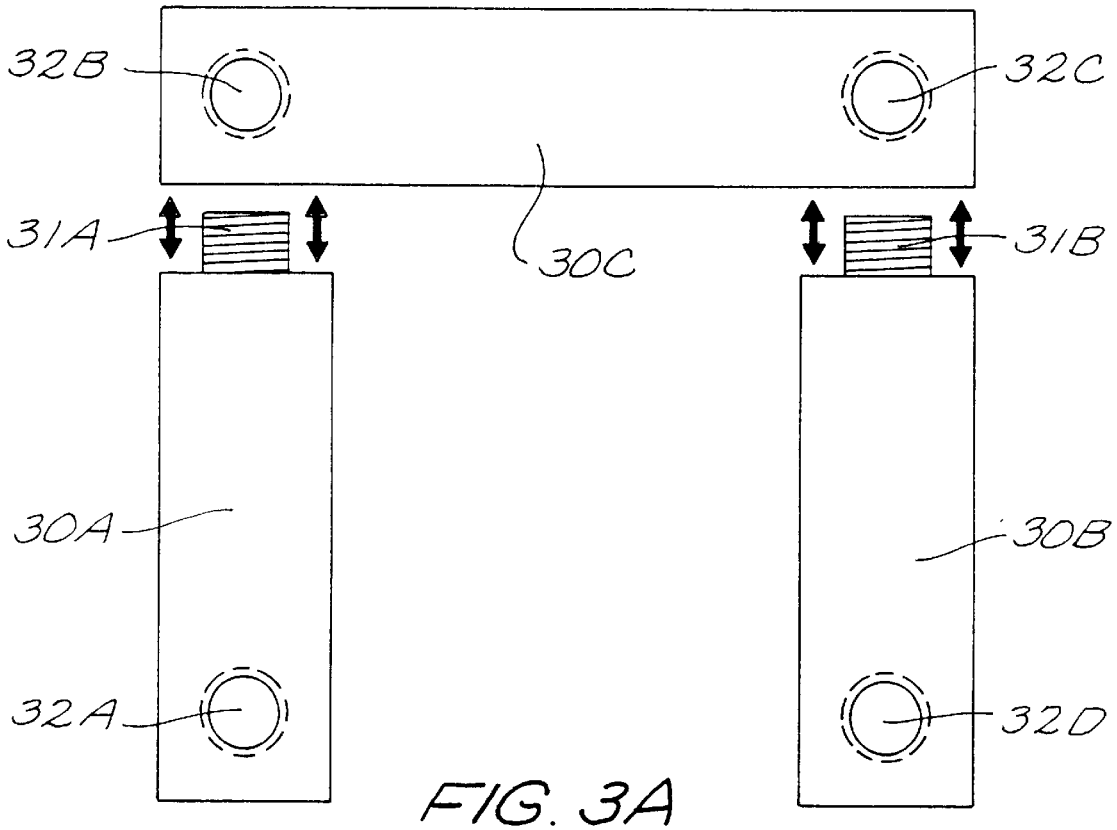
FIGS. 3A and 3B illustrate an embodiment of the invention which is collapsible for either transportation or for cleaning.
Figure 3B:
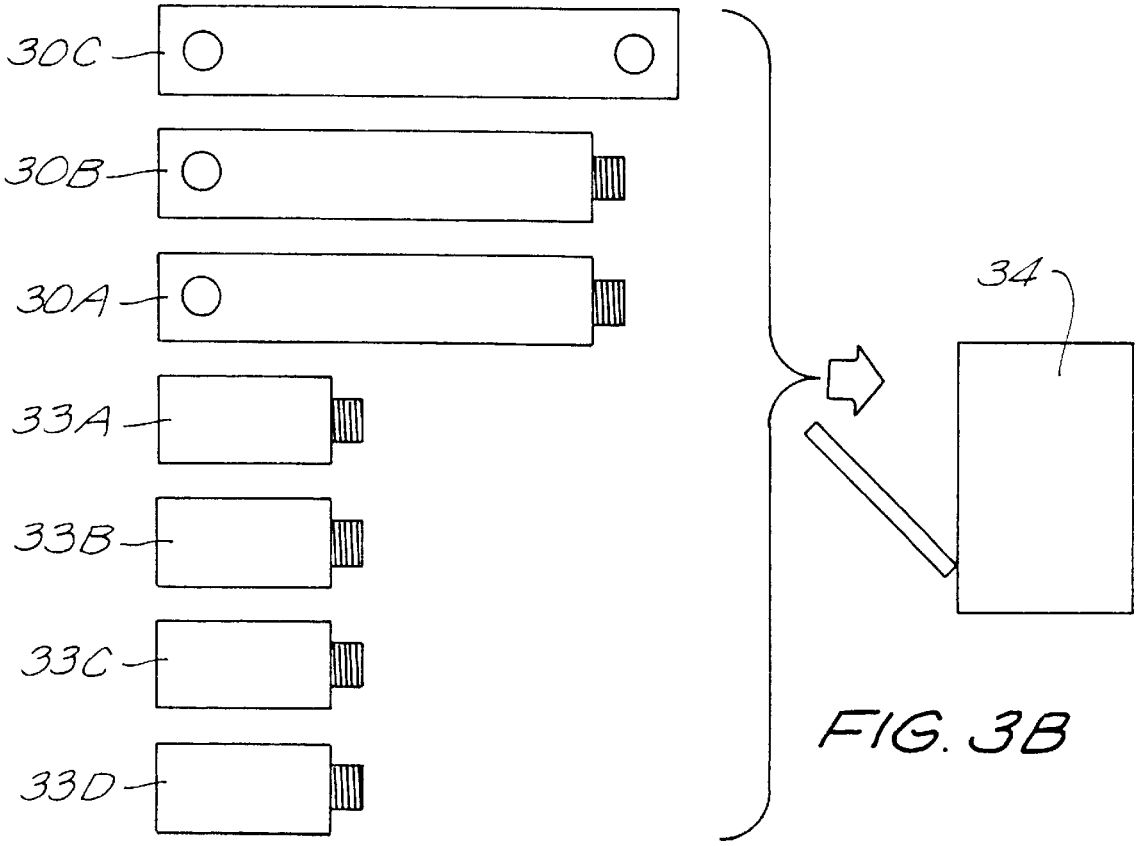

FIGS. 3A and 3B illustrate an embodiment of the invention which is collapsible for either transportation or for cleaning.

Referring to FIG. 3A, a bottom view of this embodiment, base member 30C is structured to accept extensions 30A and 30B using threaded portions 31A and 31B. Also note that leg holes 32A, 32B, 32C, and 32D are provided to accept the legs (not shown in FIG. 3A).

During transportation, the extension portions are removed to reduce the overall size and to facilitate the carrying of the apparatus.

Once disassembled, as shown in FIG. 3B, the entire structure is merely a grouping of linear pieces, namely—base member (30C), extensions (30B and 30A), and legs (33A, 33B, 33C, and 33D). The disassembled group is easily transported or placed within a washing machine 34 for efficient cleaning.

Figure 4:
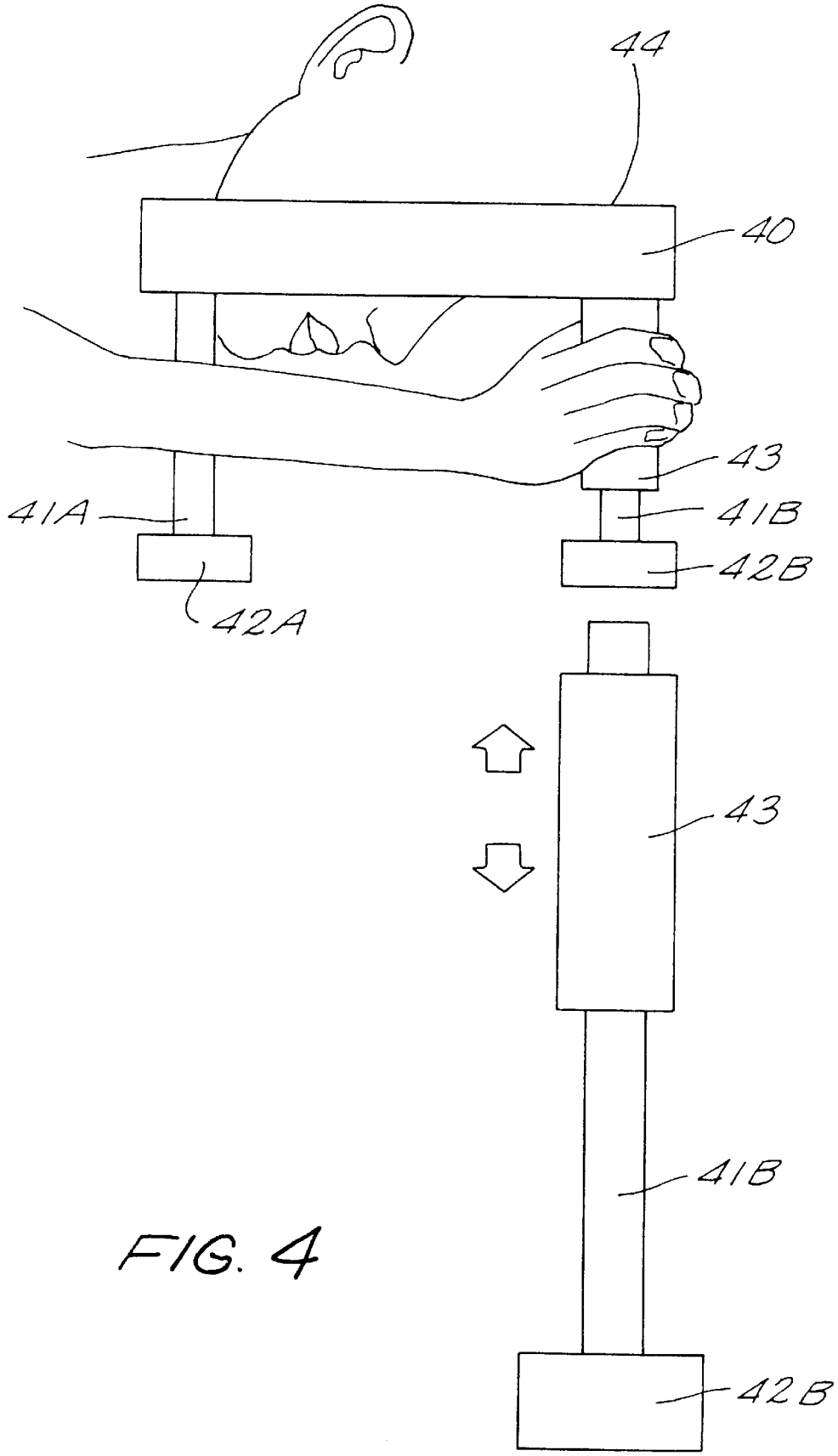
FIG. 4 is a side view of an embodiment of the invention which provides hand grips for the patient.

FIG. 4 is a side view of an embodiment of the invention which provides hand grips for the patient.

Patient 44 places their face into face-support 40. Face-support 40 is supported by legs 41A and 41B (the remaining two legs are not visible in this view). At the base of legs 41A and 41B are rubber pads 42A and 42B which provide a "soft" support for patient 44.

Patient 44 is able to grasp handle 43 on leg 41B. Handle 43, as illustrated is removable from the assembly. Leg 41B extends through a channel within handle 43. Since handle 43 is easily removed, it is cleaned or replaced with ease.

Figure 5:
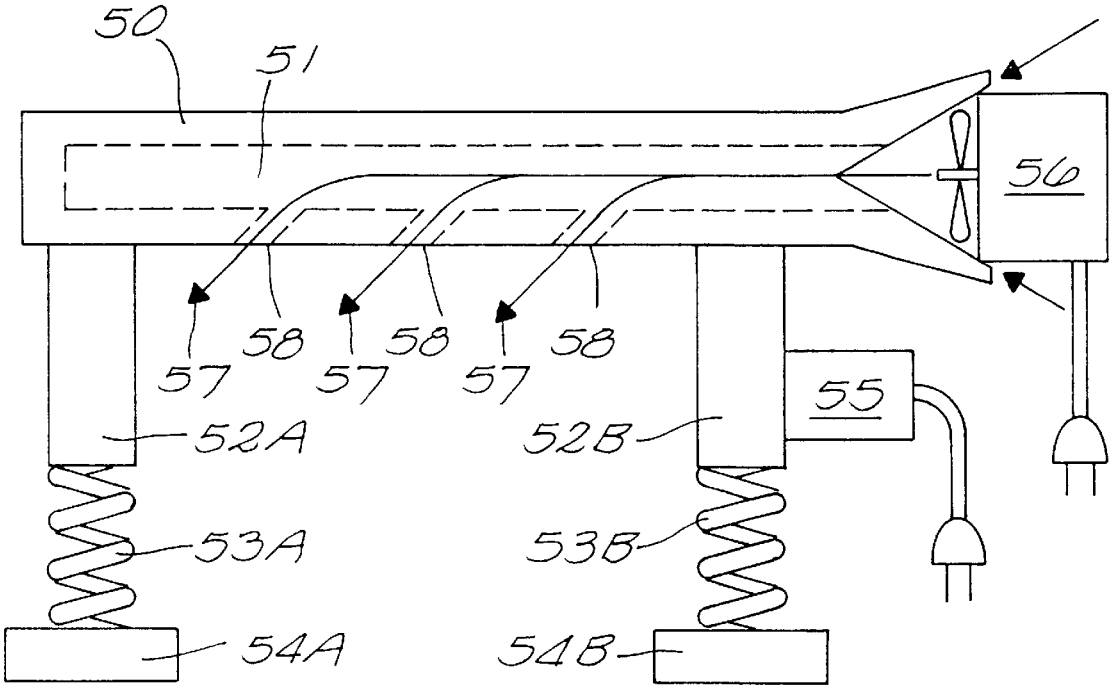
FIG. 5 is a side view of an embodiment of the invention which provides an air-flow and a vibration in the face-support.

FIG. 5 is a side view of an embodiment of the invention which provides an air-flow and a vibration in the face-support.

Channel 51 is provided within face support 50. Fan 56 is positioned to direct a flow of air into channel 51. This flow of air exits via orifices 58 as indicated by arrows 57 to provide a refreshing flow of air around the patient's face.

To further soothe the patient, vibrator 55 is connected to leg 52B. Vibrator 55 gently causes face support 50 to vibrate on spring legs 53A and 53B secured to legs 52A and 52B respectively. Spring legs 53A and 53B are secured to the table or bed using rubber pads 54A and 54B respectively.

In this manner, a gentle vibration is provided to the patient and fresh air is assured.

Figure 6:
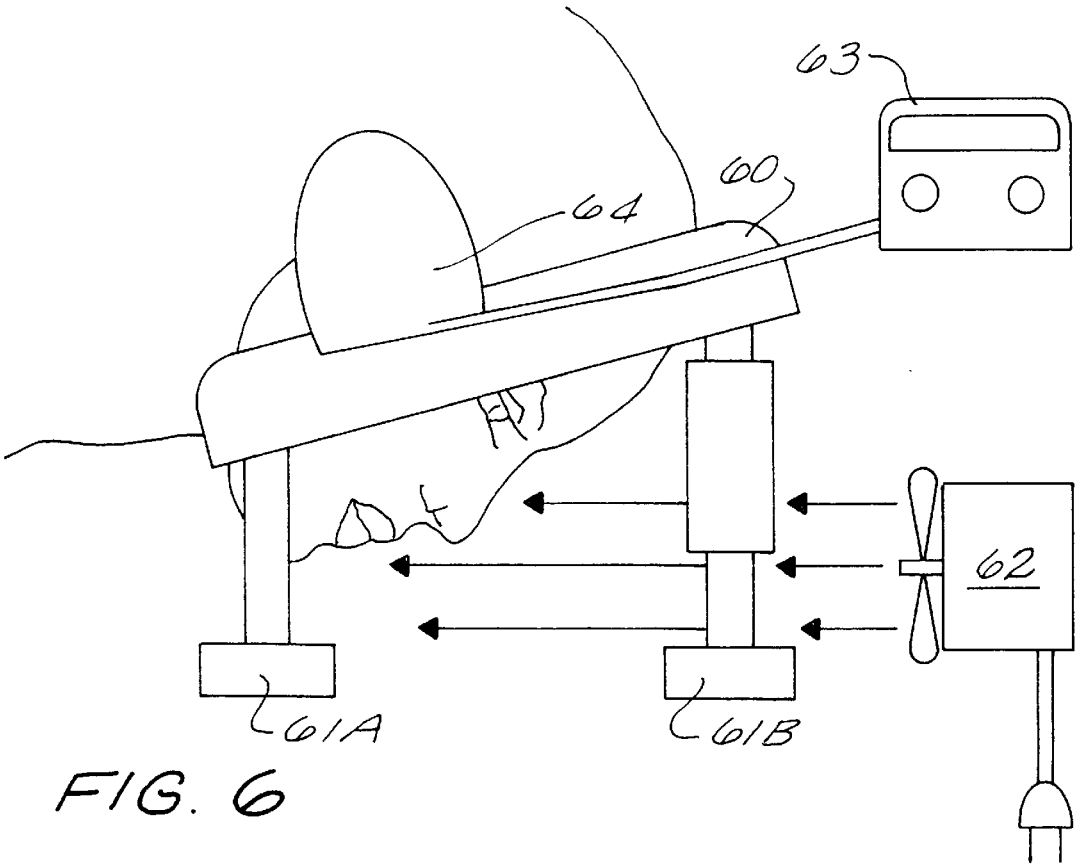
FIG. 6 is a side view of an embodiment of the invention which provides heated/cooled air as wells as music to soothe the patient.

FIG. 6 is a side view of an embodiment of the invention which provides heated/cooled air as wells as music to soothe the patient.

Face support 60 is supported by legs 61A and 61B (the other two legs are not visible from this angle). Note, in this embodiment, leg 61B is longer than leg 61A, thereby causing face support 60 to be at an angle.

Fan (which can either cool or heat the air flow) is provided to create a flow of air past the front of the patient's face. Either the patient, or the care-giver is able to adjust the speed and temperature of fan 62 so that optimal comfort is obtained.

Further, radio 63 is provided to create music which is communicated to the patient via transmitter 64 (a similar transmitter is positioned on the opposing side). Transmitter 64, in one embodiment, is a speaker which creates auditory sounds for the patient. In this embodiment, transmitter 64 is adapted to vibrate face support 60 so that the music is "heard" by conduction of the vibrations through the facial bones of the patient.

Figure 7:
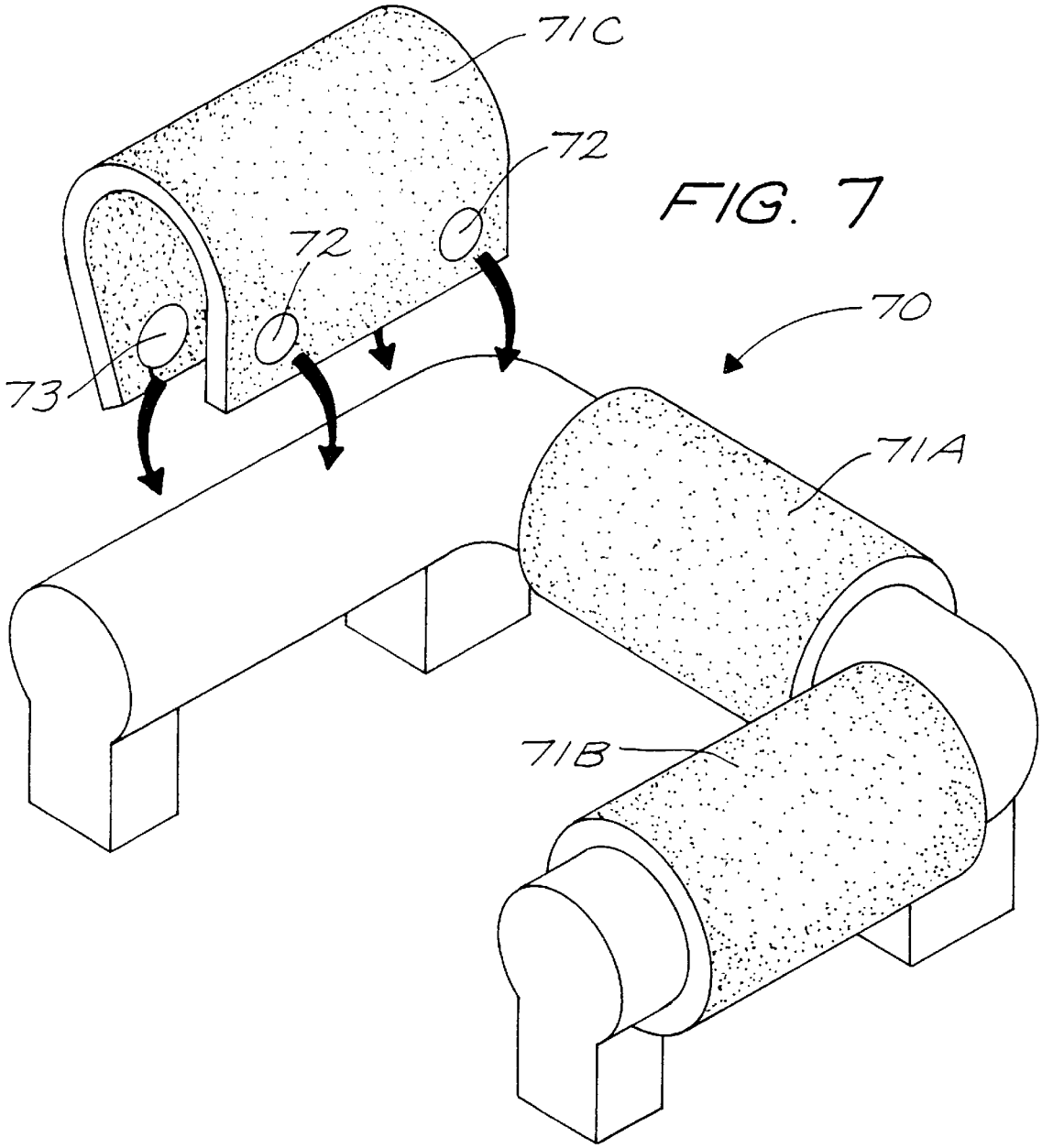
FIG. 7 is a perspective view of an embodiment of the invention illustrating the application and removal of cushions to the face rest.

FIG. 7 is a perspective view of an embodiment of the invention illustrating the application and removal of cushions to the face rest.

Head rest 70, in this embodiment is equipped with pads 71A, 71B, and 71C which totally encircle and are removable from their respective portions of head rest 70. As illustrated, pad 71C (and the other pads as well) are removable or attachable to head rest 70 using snaps 72 which engage with snap receivers 73. In an alternative embodiment, in lieu of snaps 72 and snap receivers 73, a hook-and-loop fastener such as VELCRO is used.

It is clear that the present invention creates an apparatus which is highly useful for supporting the face of a patient during treatment of their back and shoulders.

What is claimed is:

1. A headrest for a patient comprising:

a) a substantially U-shaped member being formed by a first extension, a second extension, and a base, said first extension and said second extension being removable from said base;

b) a first, second, third, and fourth leg members securable to said U-shaped member and adapted, when secured thereto, to support said U-shaped member substantially parallel to a planar surface, said first and second leg members securable to said base of said substantially U-shaped member;

c) a first, second, and third padded coverings, said first padded covering secured to said first extension, said second padded covering secured to said second extension, and said third padded covering secured to said base; and, d) a first and a second adjustment means secured to ends of said first and second leg members respectively for selectively lengthening said first and second leg members.

2. The headrest according to claim 1, wherein said first extension, said second extension, and said base each have a substantially circular cross-section.

3. The headrest according to claim 2, wherein said first extension and said second extension each include a handle graspable by a patient.

4. The headrest according to claim 3, wherein said handles are removable from said first extension and said second extension.

5. The headrest according to claim 1, further including a first, second, third, and fourth leg extension members adapted to be selectively attached to said first, second, third, and fourth leg members.

6. The headrest according to claim 1, further including means for vibrating said substantially U-shaped member.

7. The headrest according to claim 1, further including a fan adapted to direct a flow of air between said U-shaped member and the planar surface.

8. The headrest according to claim 1, a) wherein said U-shaped member is hollow and includes exit holes therein; and, b) wherein said fan is adapted to direct a flow of air into the hollow portion of said U-shaped member.

9. The headrest according to claim 8, further including means for adjusting a temperature of an airflow delivered from said fan to the hollow portion of said U-shaped member.

10. The headrest according to claim 1, wherein said first, second, and third padded coverings are removable from said U-shaped member.

11. The headrest according to claim 3, wherein said first, second, and third padded coverings are machine washable.

12. The headrest according to claim 1, wherein said U-shaped member, all of said leg members, and all of said padded coverings are machine washable.

13. The headrest according to claim 1, further including audio means for providing music, said audio means positioned proximate to said first and second extension.

14. The headrest according to claim 1, wherein said audio means is positioned to vibrate said U-shaped member.

15. A headrest adapted to receive a patient's face during treatment of a patient's posterior, said headrest comprising:

a) a U-shaped face rest supported by four removable legs, said U-shaped face rest being formed by a base with removable first and second extension members;

b) a pad being complimentary to said U-shaped face rest and adapted to be attached to said U-shaped face rest; and, c) adjustment means for operator extension of a length of each of said four removable legs.

16. The headrest according to claim 15, a) wherein said U-shaped face rest has a substantially circular cross-section; and, b) wherein at least two of said four legs include a handle graspable by a patient.

17. The headrest according to claim 15, further including means for rhythmetically vibrating said U-shaped face rest.

18. The headrest according to claim 15, further including:

a) a fan adapted to direct a flow of air past said U-shaped face rest; and, b) means for adjusting a temperature of an airflow delivered from said fan.

19. The headrest according to claim 15, further including audio means for vibrating said U-shaped face rest such that sound is conducted through said U-shaped face rest to facial bones of a patient.

* * * * *